United States Patent [19]

LeKander

[11] 4,191,412

[45] Mar. 4, 1980

[54] DOOR CLOSURE APPARATUS

[75] Inventor: William R. LeKander, Geneva, Ill.

[73] Assignee: Lyon Metal Products, Incorporated, Aurora, Ill.

[21] Appl. No.: 916,248

[22] Filed: Jun. 16, 1978

[51] Int. Cl.[2] ..... E05C 1/06

[52] U.S. Cl. ..... 292/182; 49/7; 292/DIG. 66

[58] Field of Search ..... 292/140, 169, DIG. 66, 292/182; 70/DIG. 10; 49/4, 7, 8, 360, 379; 160/1, 7, 206; 312/236

[56] References Cited

U.S. PATENT DOCUMENTS

| | | | |
|---|---|---|---|
| 1,709,305 | 4/1929 | Brunst et al. | 160/7 |
| 1,845,448 | 2/1932 | Sheard | 49/7 |
| 1,913,725 | 6/1933 | Schweig | 49/7 |
| 2,730,900 | 1/1956 | Rowley | 49/7 X |
| 3,383,796 | 5/1968 | Fredrick et al. | 49/7 |
| 3,403,954 | 10/1968 | Williams | 49/7 X |
| 3,614,975 | 10/1971 | Aymond | 160/118 X |
| 3,744,832 | 7/1973 | Casey | 292/DIG. 66 X |
| 3,777,422 | 12/1973 | Janssen | 49/7 |
| 4,007,954 | 2/1977 | Erickson | 292/DIG. 66 X |

*Primary Examiner*—J. Franklin Foss
*Attorney, Agent, or Firm*—Vogel, Dithmar, Stotland, Stratman & Levy

[57] ABSTRACT

A door closure apparatus is provided for automatically closing a bifold door of a storage cabinet for combustible materials in the event of elevated temperatures. A guide assembly hingedly mounted on the free end of the folding door includes guide fingers which ride along a guide path in a channel guide track at the top of the cabinet. At one end of the track there is mounted a bracket slidably carrying a latch member movable between a latching condition in the guide path and a release condition out of the guide path. The latch member is normally held in its latching condition by a spring and fusible link combination which override a smaller spring urging the latch member toward its release condition. Upon melting of the fusible link the latch member is moved to its release condition by the smaller spring. The latch member is shaped to permit the guide member to cam past it as the door moves to its open position but prevents return movement of the guide member to hold the door in its open position. The latch member may be manually operated.

17 Claims, 7 Drawing Figures

5.
7.
56
73
16
54
51
57
65
66
67
50
15
52
62
12
75
64
17
61
11
14
60
63
64
30
31
74
32
63
70
33
55
53
38
48
35
16
34
48
36
46
71
72
45
37
47
7.
43
40
44
41
27
22
42
26
27a
5.
21
27a
26
20
25
23

DOOR CLOSURE APPARATUS

BACKGROUND OF THE INVENTION

The present invention relates to door closure apparatus for use with doors of safety storage cabinets, such as cabinets for storing flammable or combustible material. More particularly, the present invention relates to apparatus for automatically closing the storage cabinet door in the event of elevated ambient temperatures before the temperature reaches the ignition point of the stored materials, either to prevent ignition of the combustible materials or contain the combustion thereof. The present invention particularly relates to door closure apparatus for use with hinged folding-type doors, particularly bifold doors.

Safety storage cabinets or compartments for combustible materials and automatic door closure means therefor have been in existence for many years. Also, automatic door closure means for closing doors or the like in the event of elevated temperatures are well known.

One type of prior art apparatus is disclosed in U.S. Pat. No. Re. 27,066, issued to C. E. Williams on Feb. 16, 1971. In the Williams arrangement a bifold door is spring biased toward its closed position and is manually latchable in its folded open position by means of a fusible latch member. That arrangement is disadvantageous because the latch member is hidden on top of the door in its open position, making access very cumbersome. This is inconvenient because the latch must be manually actuated each time the door is closed. Furthermore, the Williams device requires two hands to latch the door in its open position, one to hold the door open against the urging of the bias spring, and the other hand for operating the latch mechanism. Because of the inaccessible location of the fusible latch member and its method of mounting, replacement of it is also inconvenient after it has once been melted in use. Additionally, Williams uses a special fusible link design which would have to receive special approval of the interested authorities before use.

A somewhat similar arrangement is disclosed in U.S. Pat. No. 122,615 issued to G. H. Knight on Jan. 9, 1872. Knight discloses fusible latch mechanism for use on shutters and overcomes one disadvantage of the Williams arrangement in that the Knight shutters can be latched open with the use of only one hand. However, like the Williams device, replacement of the Knight latch once it has melted is extremely difficult, requiring a resoldering operation. Furthermore, Knight's shutter latch is designed to be partially mounted on an associated wall, and adaptation of it to a free standing cabinet would require opening of the doors at least 270 degrees to engage the latch. Furthermore, the Knight arrangement is not suitable for use with folding doors and the latch placement at the bottom of the shutter, while relatively accessible, is disadvantageous because the highest temperatures will be experienced at the top of the shutters.

Another type of closure arrangement is disclosed in U.S. Pat. No. 3,683,551, issued to H. Y. Martindill on Aug. 15, 1972. The Martindill device is representative of a number of similar arrangements which utilize a separate door driving mechanism which is thermally actuated automatically to close the door but which, when not in use, does not impede manual opening and closing of the door. This arrangement is complicated, cumbersome and expensive, since it must generate sufficient force to drive the entire door to its closed position. Furthermore, these arrangements are not suitable for use with folding doors.

Still another type of prior art system is disclosed in British Pat. No. 824,133 issued on Nov. 25, 1959. In this arrangement doors which are biased toward a closed position are frictionally held in an open position by a thermally releasable brake mechanism. While manual operation of the door is possible, such operation must overcome the frictional force applied by the brake mechanism. Furthermore, this arrangement does not permit the door to be positively latched in its open position. Finally, this arrangement is not readily adaptable for use with folding-type doors.

SUMMARY OF THE INVENTION

The present invention provides an improved type of door closure apparatus for the doors of safety cabinets or containers for combustible materials or the like. More specifically, the present invention provides an improved door closure apparatus which is adaptable for use with folding-type doors, while affording ease of use and servicing.

It is an important feature of the invention that the door closure apparatus includes a thermally responsive latch mechanism which normally latches the door open and is responsive to an elevated ambient temperature for unlatching the door and permitting it to close under the urging of door bias means.

Another feature of this invention is that the latch mechanism includes a fusible link which is inexpensive and easily replaceable.

In connection with the foregoing feature, another feature of the invention is that the latch mechanism is normally biased to a latching condition and, upon melting of the fusible link, becomes biased to a release condition.

In connection with the foregoing features, it is another feature of the invention that the associated door can be manually opened with the use of one hand, the latch mechanism permitting the door to be cammed past it as the door opens.

Still another feature of the invention is that the door closure apparatus provides a guide mechanism uniquely adaptable for guiding the movement of a folding door, and which also coacts with the latch mechanism for latching the door in its open position.

In summary, there is provided door closure apparatus for a combustible material storage cabinet having a door biased toward a closed position, the apparatus comprising latch mechanism associated with the cabinet and movable between a latching condition for holding the associated door in an open position and a release condition permitting movement of the door between its open and closed positions, and thermally responsive latch control means coupled to the latch mechanism, the latch control means being responsive to a predetermined elevated ambient temperature for moving the latch mechanism to its release condition thereby to permit biased movement of the door to its closed position.

Further features of the invention pertain to the particular arrangement of the parts of the door closure apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
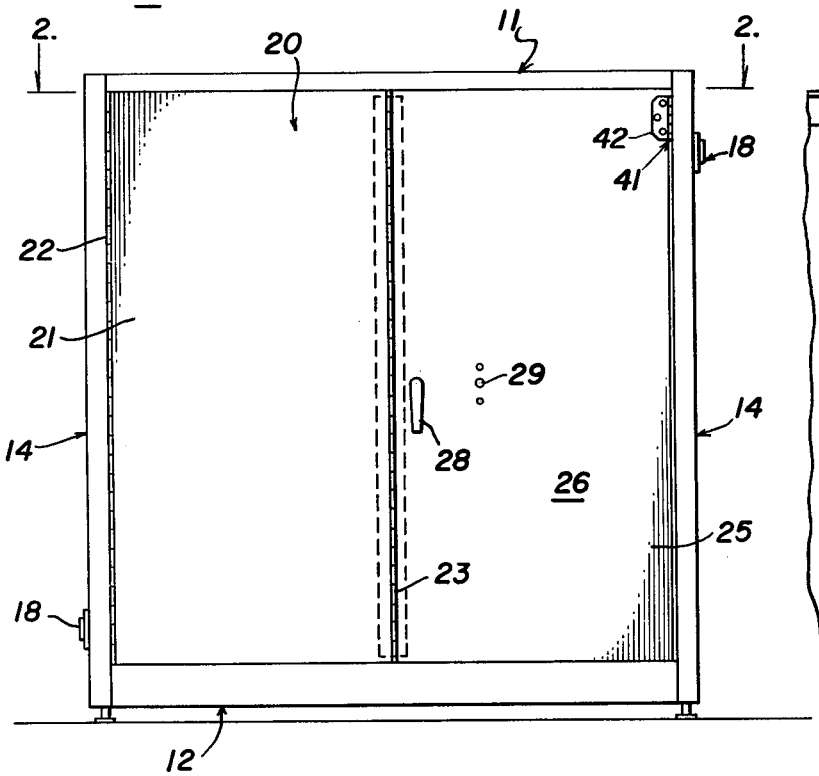
FIG. 1 is a front elevational view of a safety storage cabinet having bifold doors disposed in a closed position and utilizing the door closure apparatus of the present invention.
Figure 3:
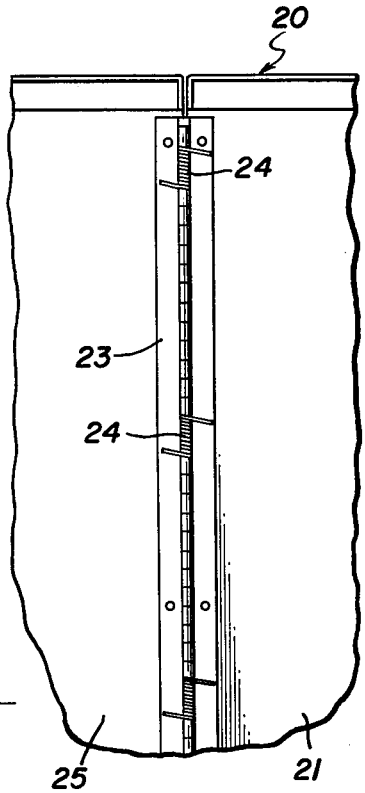
FIG. 3 is an enlarged fragmentary rear elevational view of the folding door disposed in the closed position illustrated in FIG. 1.
Figure 2:
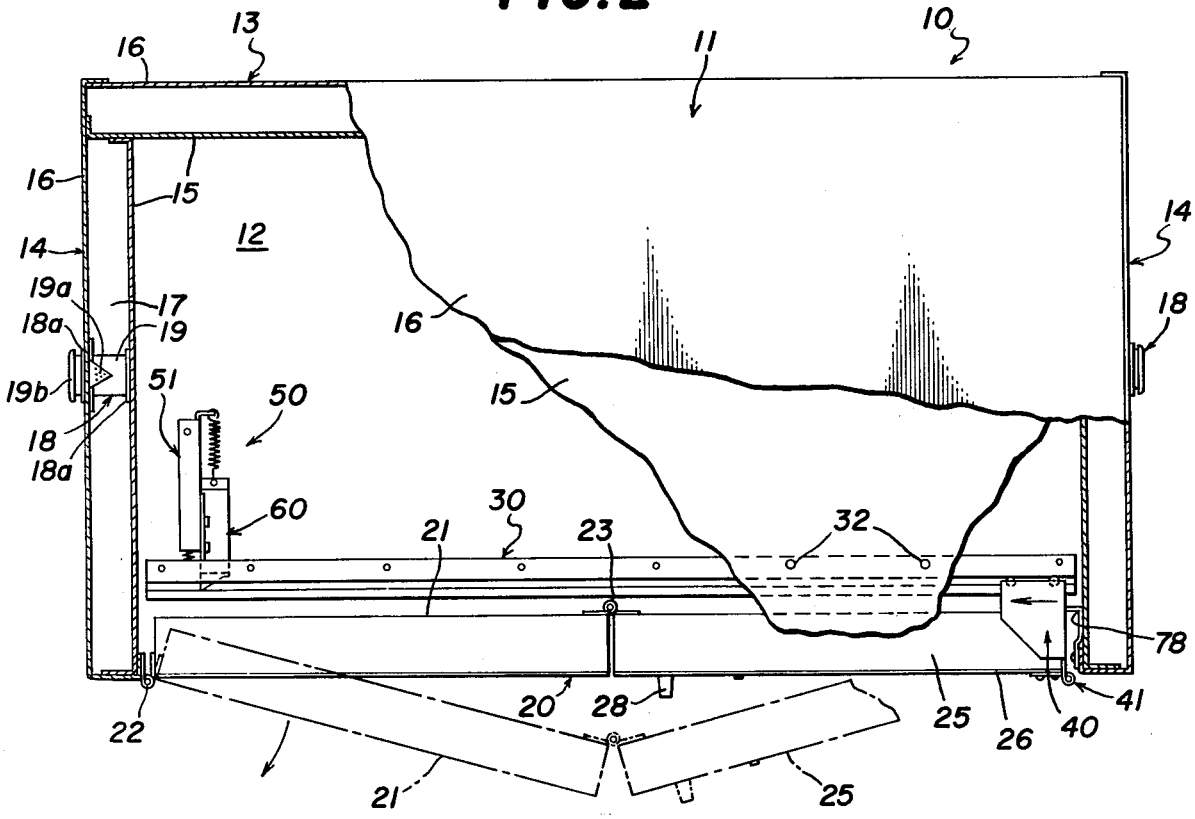
FIG. 2 is an enlarged fragmentary view in horizontal section taken along the line 2—2 of FIG. 1, and illustrating the movement of the folding door.

Referring now to FIGS. 1 through 3 of the drawings, there is illustrated a safety storage cabinet, generally designated by the numeral 10, which is of the type for storing combustible materials. The cabinet 10 is an independent freestanding unit, preferably formed of metal, but it will be appreciated that it could also be built into a wall or the like. The cabinet 10 is of generally rectangular box-like configuration having a top wall 11, a bottom wall 12, a rear wall 13 and a pair of opposed side walls 14, the front edges of the walls 11, 12 and 14 defining a rectangular opening or doorway. Preferably, in order to achieve adequate thermal insulation of the cabinet 10, each of the walls 11–14 is of double-wall construction, including an inner panel 15 and an outer panel 16 which are spaced apart and parallel and closed at the peripheral edges, and which cooperate to define therebetween an insulating space 17. The insulating space 17 may contain air or any other suitable thermally insulating material. Each of the side walls 14 is provided with a vent assembly 18 providing communication between the interior and the exterior of the cabinet 10. Each vent assembly 18 includes two annular pipe flanges 18*a* respectively mounted in the inner and outer panels 15 and 16, and interconnected by a cylindrical collar 19 having the outer end thereof covered with a perforated steel flame arrestor plate which is bent back along the collar 19 and spot welded thereto as at 19*a*. Normally at least one of the pipe flanges 18*a* is closed by a steel plug 19*b*, which may be removed for connection of a vent pipe to vent vapors from within the cabinet 10 to the outside of the room where the cabinet is located.

Mounted at the front of the cabinet 10 is a bifold door, generally designated by the numeral 20, which includes a first rectangular panel or section 21 hingedly mounted along one side edge thereof to one of the side walls 14 by a piano-type hinge 22, and hingedly coupled along the other side edge thereof by means of a piano-type hinge 23 to the adjacent side edge of a second panel or section 25. Preferably, the hinge 23 includes a plurality of longitudinally spaced-apart torsion springs 24 therein disposed for resiliently urging the panels 21 and 25 toward an open substantially coplanar configuration, illustrated in solid line in FIGS. 1 through 3. Each of the door sections 21 and 25 may be of double-wall construction and includes an outer panel 26 which faces outwardly when the door 20 is closed, as illustrated in FIG. 1, and extends a predetermined distance above and below a parallel inner panel and is connected to the peripheral edges thereof by a peripheral wall having a distal end surface 27 and a top surface 27*a* (see FIG. 4).

In use, the door 20 is hingedly movable between its unfolded fully closed position and a folded, fully open position (see FIG. 4) in a well-known manner, an intermediate position being illustrated in broken line in FIG. 2. Preferably, the door 20 is provided with a latch mechanism including a latch handle 28 to facilitate manual opening and closing of the door 20 and, if desired, may be provided with a suitable lock 29. It will be understood that, by reason of the torsion springs 24, the door 20 is normally biased to its closed position.

Figure 4:
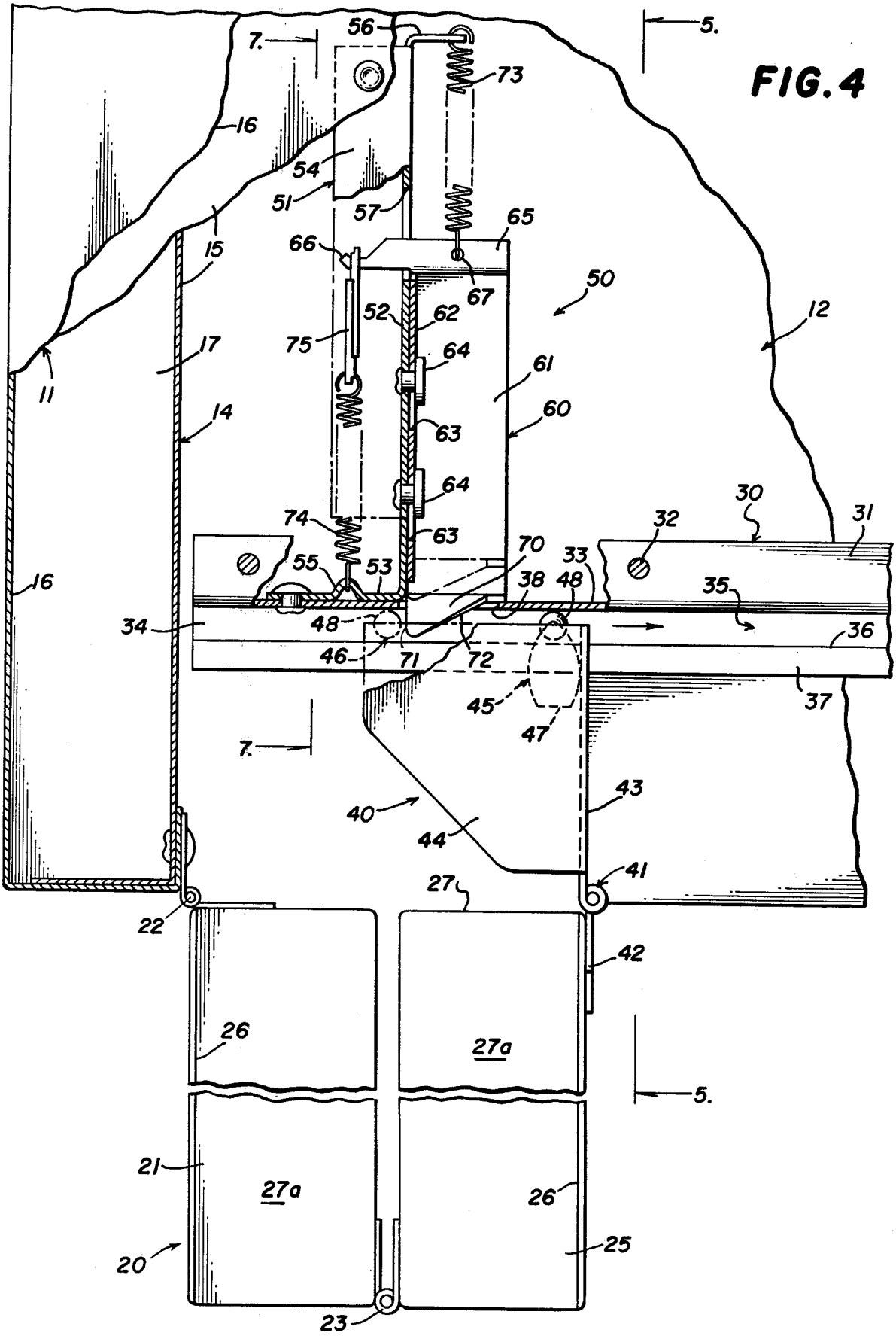
FIG. 4 is a still further enlarged horizontal sectional view of the left front corner of the cabinet as illustrated in FIG. 2, with the door illustrated in its fully open position and illustrating the details of the latch assembly in its latching condition holding the door open.

Referring now also to FIGS. 4 through 7 of the drawings, there is provided an elongated guide track, generally designated by the numeral 30, which is preferably formed of metal and is disposed along the inner surface of the cabinet top wall 11 adjacent to and parallel to the front edge thereof. The guide track 30 includes an elongated rectangular mounting flange 31 which lies flat against the inner surface of the cabinet top wall 11 and is fixedly secured thereto as by pop rivets 32. Integral with the mounting flange 31 along the front edge thereof is a channel, generally designated by the numeral 35, which is substantially U-shaped in transverse cross section. The channel 35 includes an elongated rear flange 33 integral with the mounting flange 31 and extending downwardly therefrom substantially normal thereto. Integral with the rear flange 33 along its bottom edge and extending forwardly therefrom is a bottom flange 34, having a front flange 36 extending upwardly therefrom along the front edge thereof substantially parallel to the rear flange 33. The upper edge of the front flange 36 is preferably disposed below the upper edge of the rear flange 33 and has integral therewith a forwardly extending lip flange 37. Formed in the rear flange 33 adjacent to the left-hand end thereof, as viewed in FIG. 4, is an elongated slot 38, for a purpose to be described below.

Mounted on the door 20 is a guide assembly, generally designated by the numeral 40. More particularly, the guide assembly 40 includes a hinge apparatus, generally designated by the numeral 41, including a fixed hinge plate 42 fixedly secured, as by pop rivets, to the outer panel 26 of the door section 25 adjacent to the upper end thereof and adjacent to the distal end surface 27. The hinge apparatus 41 also includes a free vertically extending hinge plate 43 pivotally movable with respect to the fixed plate 42 and having integral therewith at the upper edge thereof a horizontally extending top flange 44. The hinge apparatus 41 is so positioned and dimensioned that the free plate 43 is pivotally movable between an open position illustrated in FIG. 4, substantially parallel to the fixed plate 42, and a closed position, illustrated in FIG. 2, flat against the distal end surface 27 of the door section 25. When the hinge plate 43 is in its closed position, the top flange 44 thereof overlies the top surface 27*a* of the door section 25 substantially parallel thereto, the clearance between that top surface 27*a* and the inner surface of the cabinet top wall 11 being sufficient to accommodate the top flange 44.

Fixedly secured to the top flange 44 along a front edge thereof which extends substantially normal to the free hinge plate 43 are two identically constructed and spaced-apart guide members 45 and 46. Each of the guide members 45 and 46 includes an attachment portion 47, fixedly secured as by welding to the underside of the top flange 44, and a substantially cylindrical guide finger 48 extending downwardly from the attachment portion 47 substantially normal to the top flange 44 and dimensionsed for insertion into the channel 35 of the guide track 30 for movement longitudinally thereof.

It will be appreciated that the guide fingers 48 cooperate with the guide track 30 to guide the movement of the free end of the door section 25 as the door 20 is moved between the fully closed unfolded position thereof, illustrated in solid line in FIG. 2, and the fully open folded configuration thereof illustrated in FIG. 4. The use of two spaced-apart guide fingers 48 serves to effect a smooth, non-wobbling movement of the door 20 between its open and closed positions by inhibiting any pivotal movement of the guide assembly 40 with respect to the guide track 30.

Fixedly secured to the guide track 30 adjacent to the left-hand end thereof, as viewed in FIGS. 2 and 4, is a latch assembly, generally designated by the numeral 50. More particularly, the latch assembly 50 is disposed in use along the underside of the cabinet top wall 11 adjacent to the left front corner thereof and includes a bracket, generally designated by the numeral 51, having an elongated rectangular guide flange 52 disposed substantially parallel to the adjacent cabinet side wall 14. Integral with the guide flange 52 at the front end thereof and extending laterally therefrom substantially normal thereto toward the adjacent cabinet side wall 14 is a front attachment flange 53 which is fixedly secured to the rear flange 33 of the guide track 30 as by a pop rivet. Integral with the guide flange 52 along the upper edge thereof and extending laterally therefrom parallel to the cabinet top wall 11 and toward the adjacent cabinet side wall 14 is a top attachment flange 54 which is fixedly secured to the cabinet top wall 11 as by pop rivets. Punched rearwardly from the front attachment flange 53 is a mounting loop 55 for a purpose to be described below. Integral with the guide flange 52 at the rear end thereof and extending laterally therefrom in the opposite direction from the front attachment flange 53 is a rear tab 56. Formed in the guide flange 52 toward the rear end thereof is an elongated slot 57.

Slidably mounted on the bracket 51 is an elongated latch member, generally designated by the numeral 60, which includes a rectangular horizontally disposed main plate 61 provided along one edge thereof with an upwardly extending rectangular attachment flange 62 which is disposed in parallel back-to-back relationship with the guide flange 52 of the bracket 51. The attachment flange 62 is provided with a pair of elongated slots 63 therein through which are respectively received two shoulder rivets 64 for slidably coupling the latch member 60 to the bracket 51. Integral with the main plate 61 at the rear end thereof and extending upwardly and rearwardly therefrom is a rear flange 65 provided with a coupling finger 66 which extends laterally through the slots 57 in the bracket guide flange 52. The rear flange 65 is also provided with an aperture 67 therethrough.

Fixedly secured to the main plate 61 adjacent to the front end thereof and extending downwardly therefrom substantially normal thereto is a handle tab 68. Also integral with the main plate 61 at the front end thereof and extending upwardly and forwardly from the handle tab 68 is a latch tab, generally designated by the numeral 70, which is provided along one edge thereof with a stop surface 71 disposed substantially coplanar with the attachment flange 62. The latch tab 70 also includes a cam surface 72 which is inclined at a predetermined acute angle with respect to the stop surface 71 and extends rearwardly therefrom toward the opposite side edge of the main plate 61.

Figures 5, 6, 7:
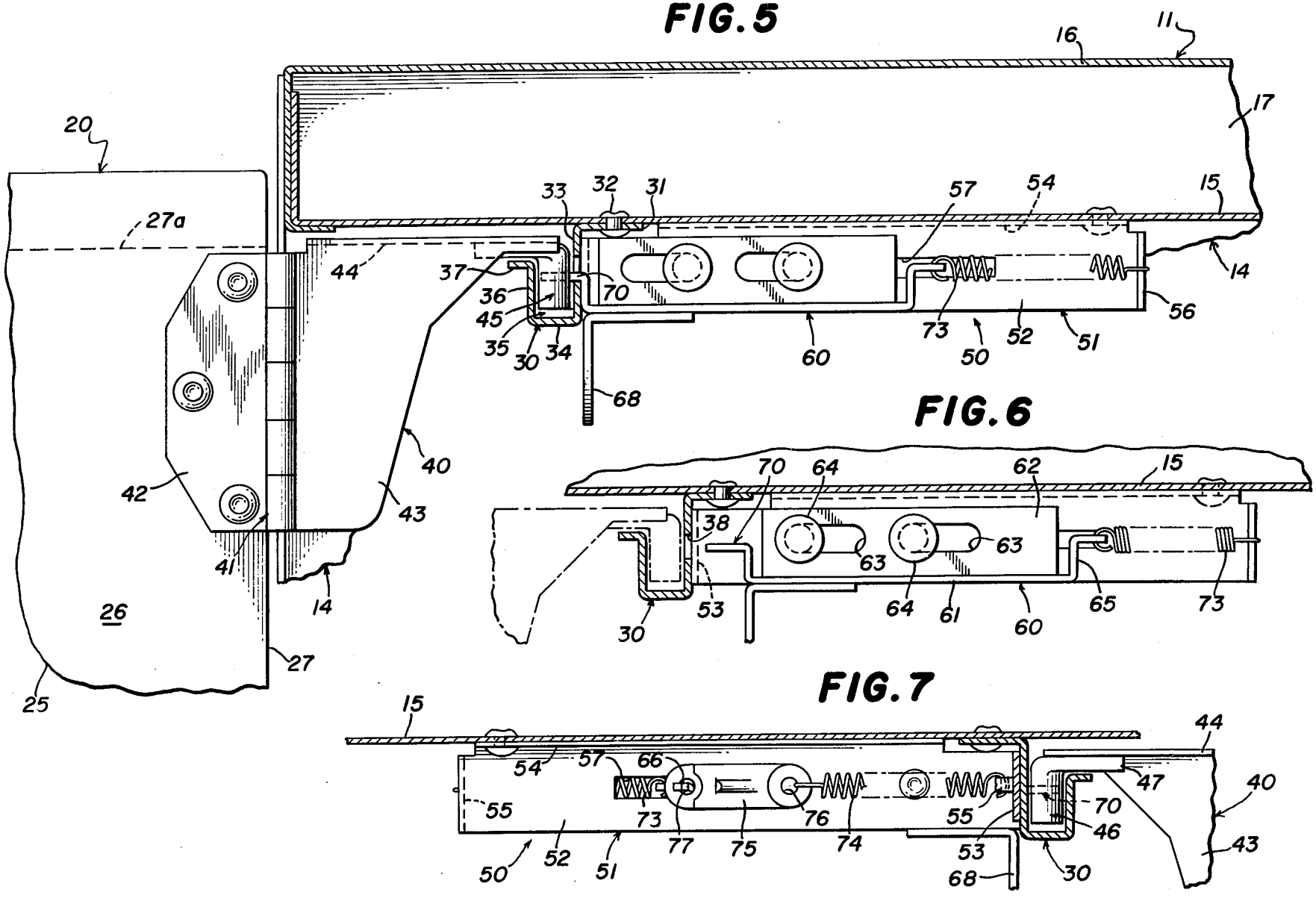
FIG. 5 is a fragmentary view in vertical section taken along the line 5—5 in FIG. 4.
FIG. 6 is a fragmentary view similar to FIG. 5, illustrating the latch mechanism in its release condition.
FIG. 7 is a fragmentary view in vertical section taken along the line 7—7 in FIG. 4.

The dimensions of the slots 57 and 63 are such as to permit movement of the latch member 60 with respect to the bracket 51 between a forward latching position, illustrated in FIGS. 4, 5 and 7, wherein the latch tab 70 projects through the slot 38 in the guide track 30 and into the channel 35 obstructing the path of the guide fingers 48 therealong, and a rearward retracted position, illustrated in FIG. 6 and in broken line in FIG. 4, wherein the latch tab 70 is completely withdrawn from the guide track channel 35.

The latch assembly 50 also includes a first helical tension spring 73 having one end thereof coupled to the aperture 67 in the rear flange 65 of the latch member 60 and having the other end thereof coupled in an aperture in the bracket rear tab 56 for resiliently urging the latch member 60 toward its retracted position with a first predetermined force. There is also provided a second helical tension spring 74 having one end thereof anchored to the bracket mounting loop 55 and having the other end thereof received in an aperture 76 (see FIG. 7) at one end of a fusible link 75, the other end of which is provided with an aperture 76 receiving therethrough the coupling finger 66 of the latch member 60. The spring 74 exerts a greater force than the spring 73 and cooperates with the fusible link 75 to overpower the spring 73 and normally hold the latch member 60 in its latching position.

In assembling the cabinet 10, the latch assembly 50 is first secured to the guide track 30 and the guide fingers 48 of the guide assembly 40 are inserted into the channel 35, before the guide track 30 and bracket 51 are secured to the cabinet top wall 11. Then the guide assembly 40 is secured to the door section 25. Thus, the guide fingers 48 will effectively be trapped in the channel 35.

In use, when the door 20 is in its unfolded closed position, illustrated in FIG. 2, the latch member 60 will be held in its latching position and the door 20 will close the cabinet doorway, with the guide assembly free plate 43 being disposed flat against the distal end surface 27 of the door section 25, as described above. A suitable door stop member 78 is provided along the right-hand one of the cabinet side walls 14 for cooperation with the door 20 to provide a more effective closure of the cabinet 10.

The door 20 may be opened by simply manually grasping the handle 28 with one hand, turning it to unlatch the door 20, and pulling it outwardly, thereby causing the door 20 to begin to fold, as indicated in broken line in FIG. 2, and pulling the guide fingers 48 of the guide assembly 40 along the channel 35 to the left, as indicated by the broken line arrow in FIG. 2. As the door 20 opens, the movement thereof is guided by the sliding of the guide fingers 48 in the channel 35, this guiding being accommodated by the pivoting of the guide assembly free plate 43. When the door 20 is fully opened the sections 21 and 25 thereof will be disposed substantially parallel to the adjacent cabinet side wall 14 and will not swing past this parallel position because of the limiting action of the guide assembly 40.

As the door 20 moves to its fully open and folded position, the guide finger 48 of the leading guide member 46 engages the cam surface 72 of the latch tab 70 and urges the latch member 60 rearwardly against the force of the tension spring 74 to permit the guide finger 48 to cam past the latch tab 70 to the position illustrated in FIG. 4. As soon as the guide finger 48 has moved past the latch tab 70, the latch member 60 snaps back to its latching position under the urging of the tension spring 74, wherein the stop surface 71 blocks the path of the guide finger 48 and prevents its return movement back past the latch tab 70 to the right, as viewed in FIG. 4. Thus, the latch tab 70 cooperates with the guide finger 48 of the leading guide member 46 securely to hold the door 20 in its fully open position. If it is desired to reclose the door 20, a user simply pushes rearwardly on the handle tab 68 for moving the latch member 60 back to its release position, and as soon as the latch tab 70 is thus withdrawn from the channel 35, the door 20 will return to its closed position under the urging of the hinge bias springs 24. Thus, it will be appreciated that both opening and closing of the door 20 requires only one hand.

In the event of elevation in the ambient temperature, such as by a fire within or in the vicinity of the cabinet 10, when the ambient temperature reaches a predetermined level, the fusible link 75 will melt, thereby releasing the latch member 60 from the tension spring 74 and permitting the latch member 60 to be moved to its release position under the urging of the tension spring 73. If the door 20 is in its open position when this occurs, the retraction of the latch member 60 will permit the door 20 automatically to close under the urging of its hinge bias springs 24. In this regard, it will be noted that the positioning of the latch assembly 50 within the cabinet 10 at the top front region thereof insures response of the latch assembly 50 to elevated ambient temperature in the vicinity of the combustible contents of the cabinet 10, whether the source of that temperature elevation is within or without the cabinet 10.

It is a significant feature of the present invention that, after the fusible link 75 has been consumed by melting, it can easily be replaced by simply reaching up beneath the bracket 51 and hooking a new fusible link first onto the adjacent end of the spring 74 and then onto the coupling finger 66 of the latch member 60. Furthermore, because the only thing which is actuated by the melting of the fusible link 75 is the latch member 60, only small inexpensive springs are necessary and no heavy-duty drive mechanism is required as in the prior art thermally actuated door driving devices. Additionally, it will be appreciated that the automatic door closure apparatus of the present invention is uniquely adapted for use with bifold doors, which affords important space-saving advantages. In this regard, while a bifold door has been illustrated in the preferred embodiment of the invention, it will be appreciated that the present invention could also be readily adapted for use with folding doors having more than two sections.

In a constructional model of the present invention, the guide track 30, guide assembly 40 and latch assembly 50 are all formed of metal, preferably steel. The fusible link 75 is preferably a commercially available fusible link which comprises two pieces of brass soldered together with a special fusible solder, and being adapted to melt at approximately 160 degrees F.

From the foregoing, it can be seen that there has been provided an improved automatic door closure apparatus for use with a safety cabinet for storing combustible material, which apparatus avoids disadvantages of prior art structures while affording economical construction and great simplicity of use and servicing.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. Door closure apparatus for a combustible material storage cabinet having a door biased toward a closed position, said apparatus comprising a bracket mounted on the associated cabinet, a latch member carried by said bracket for movement between a latching condition for holding the associated door in an open position and a release condition permitting movement of the door between its open and closed positions, first bias means coupled to said bracket and said latch member and urging said latch member to its release condition with a first predetermined force, and second bias means including a fusible link and coupled to said bracket and said latch member for urging said latch member to its latching condition with a second predetermined force greater than said first force thereby normally to hold said latch member in its latching condition, said second bias means being responsive to melting of said fusible means for removing said second force from said latch member and permitting movement of said latch member to its release condition by said first bias means thereby to permit biased movement of the door to its closed position.

2. The door closure apparatus of claim 1, wherein each of said first and second bias means is a helical spring.

3. The door closure apparatus of claim 1, wherein said first bias means is a tension spring connected between one end of said bracket and the adjacent end of said latch member, said fusible link being connected to said adjacent end of said latch member, and said second bias means including a second tension spring connected between said fusible link and the other end of said bracket.

4. The door closure apparatus of claim 3, wherein said fusible link has two apertures respectively disposed at the opposite ends thereof, one end of said second tension spring being received in one of said apertures, and said latch member including a coupling finger receivable in the other one of said apertures.

5. The door closure apparatus of claim 1, wherein said latch member and said first bias means are disposed on one side of said bracket and said second bias means is disposed on the opposite side of said bracket, said bracket having an aperture therethrough from the one side to the opposite side thereof, and said latch member including a finger extending through said aperture and coupled to said second bias means.

6. The door closure apparatus of claim 1, wherein said latch member includes handle means for effecting manual operation of said latch member between the latching and release conditions thereof.

7. The door closure apparatus of claim 1, wherein said latch member has a cam surface thereon, and further including cam means carried by the door for camming engagement with said cam surface to effect cammed movement of said latch member to the release condition thereof against the urging of said second bias means to permit movement of the door from its closed position to its open position.

8. Door closure apparatus for a combustible material storage cabinet having a door biased to a closed position, said apparatus comprising in combination a guide track carried by the associated cabinet and defining a guide path, a guide member carried by the associated door and disposed in said guide track for movement along said guide path to guide movement of the door between its open and closed positions, latch mechanism associated with the cabinet and movable between a latching condition disposed in said guide path for engagement with said guide member to hold the associated door in an open position and a release condition out of said guide path for permitting movement of the door between its open and closed positions, and thermally responsive latch control means coupled to said latch mechanism, said latch control means being responsive to a predetermined elevated ambient temperature for moving said latch mechanism to its release condition thereby to permit biased movement of the door to its closed position.

9. The door closure apparatus of claim 8, and further including bias means urging said latch mechanism to the latching condition thereof, and cam means carried by the door for camming engagement with said latch mechanism for effecting movement thereof to the release condition thereof against the urging of said bias means to permit movement of the door from its closed position to its open position.

10. The door closure apparatus of claim 8, wherein said guide path extends substantially horizontally adjacent to the top of the associated cabinet.

11. The door closure apparatus of claim 8, wherein said guide track comprises an elongated open-top channel substantially U-shaped in transverse cross section, said guide member including an attachment means mounted on the associated door and a guide finger carried by said attachment means and extending downwardly into said channel.

12. The door closure apparatus of claim 8, and further including means hingedly mounting said guide member on the associated door for adapting said guide member to use with a bifold door.

13. The door closure apparatus of claim 8, wherein said latch control means includes fusible means and is responsive to melting of said fusible means for moving said latch mechanism to its release condition.

14. Door closure apparatus for a combustible material storage cabinet including a folding door having a plurality of hingedly interconnected sections extending between a mounting end hingedly mounted on the associated cabinet and a free end opposite the mounting end wherein the door is biased to a closed unfolded position, said apparatus comprising in combination a guide track carried by the associated cabinet and defining a guide path, a guide assembly hingedly mounted on the associated door adjacent to the free end thereof and including a guide member disposed in said guide track for movement along said guide path, the hinged mounting of said guide assembly accommodating the changing orientations of the associated door sections while maintaining said guide member in said guide track as the door moves between its open and closed positions, latch mechanism associated with the cabinet and movable between a latching condition disposed in said guide path for engagement with said guide member to hold the associated door in an open position and a release condition out of said guide path for permitting movement of the door between its open and closed positions, and latch control means coupled to said latch mechanism and including fusible means, said latch control means being responsive to melting of said fusible means for moving said latch mechanism to its release condition thereby to permit biased movement of the door to its closed position.

15. The door closure apparatus of claim 14, wherein said guide track comprises an elongated open-top channel substantially U-shaped in transverse cross section, said guide member including an attachment means mounted on the associated door and a guide finger carried by said attachment means and extending downwardly into said channel.

16. The door closure apparatus of claim 14, wherein said guide assembly includes two guide members disposed in said guide track and spaced apart longitudinally thereof, one of said guide members being engageable with said latch mechanism for holding the associated door in its open position.

17. The door closure apparatus of claim 14, wherein said latch control means includes bias means urging said latch mechanism to the latching condition thereof, said latch mechanism having a cam surface thereon disposed for camming engagement by said guide member to effect cammed movement of said latch mechanism to the release condition thereof against the urging of said bias means to permit movement of the associated door from its closed position to its open position.

* * * * *